US005524990A

United States Patent [19]

Buck

[11] Patent Number: 5,524,990

[45] Date of Patent: Jun. 11, 1996

[54] FLEXIBLE CONTAINER

[76] Inventor: Jennifer E. Buck, P.O. Box 709, Mantoloking, N.J. 08738

[21] Appl. No.: 452,254

[22] Filed: May 26, 1995

[51] Int. Cl.[6] ..... B65D 33/02; B65D 33/30

[52] U.S. Cl. ..... 383/34; 383/95; 383/104

[58] Field of Search ..... 383/33, 34, 78, 383/80, 81, 84, 86, 93, 95, 104; 150/119, 120

[56] References Cited

U.S. PATENT DOCUMENTS

| | | | |
|---|---|---|---|
| 91,075 | 6/1869 | Borst et al. | 383/34 X |
| 1,111,091 | 9/1914 | Pauli | 383/104 X |
| 1,338,375 | 4/1920 | Kleidman | 383/34 X |
| 2,084,747 | 6/1937 | Alter | 383/34 |
| 2,227,390 | 12/1940 | Green | 383/34 |
| 2,325,853 | 8/1943 | Harlem | 383/104 X |
| 2,695,647 | 11/1954 | Deutsch | 150/119 X |

OTHER PUBLICATIONS

Article (part of a page) titled "Storage Solutions" No date.

Brochure (four pages) titled "Sealline Dry Bags" by Cascade Designs Inc. 1993 no month.

Pamphlet (two pages) titled "Closure Instructions for Cascade Designs Sealline Dry Bags" Jul. 1994.

*Primary Examiner*—Jes F. Pascua

*Attorney, Agent, or Firm*—Edward D. C. Bartlett

[57] ABSTRACT

A flexible, preferably transparent, container for food or other contents has a pliable body of flexible plastic material, the body having an opening with a closure flap extending from one side of the opening. The flap forms a continuation of the body and is pivotal relative to the body to close and open the opening. A stiffened portion is disposed around a peripheral portion of the opening opposite the one side, and another stiffened portion is disposed around a periphery of the flap. These stiffened portions are hingedly connected at opposite ends of the one side. The flap stiffened portion moves inside the opening stiffened portion when the flap closes the opening. The pliable body is collapsible to a collapsed disposition for storage when empty, and is variably adapted in size between the collapsed disposition and an expanded maximum size disposition depending upon the volume of contents to be stored in the container. The body may have a base portion defined by a stiffened section on which the container is stably standable. The container may be used in a freezer, a microwave, and a dishwasher.

20 Claims, 8 Drawing Sheets

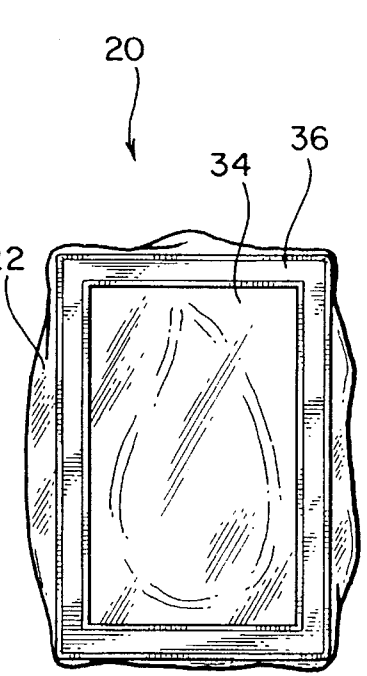
FIG. 1
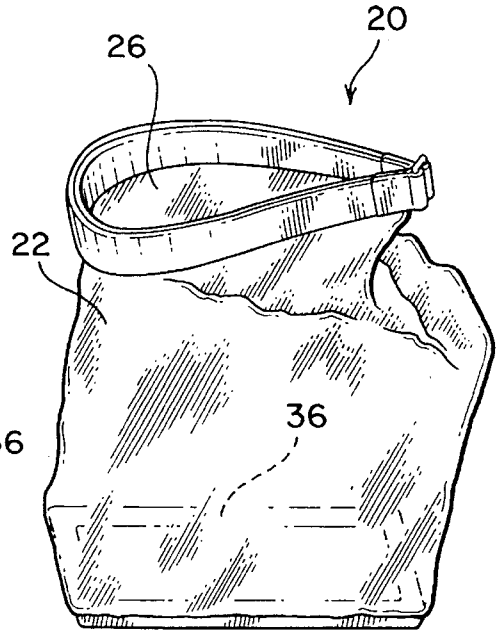
FIG. 2
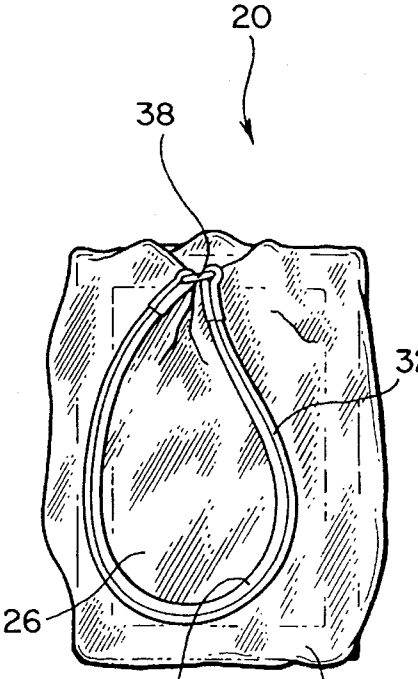
FIG. 3
FIG. 4

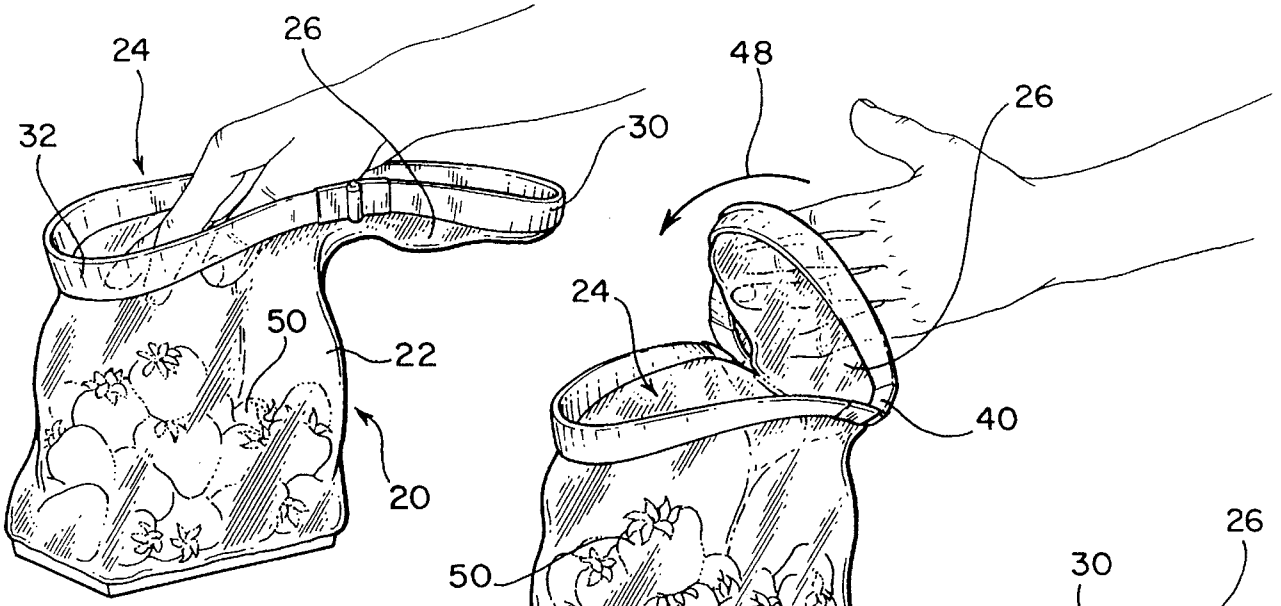
FIG. 8
FIG. 9
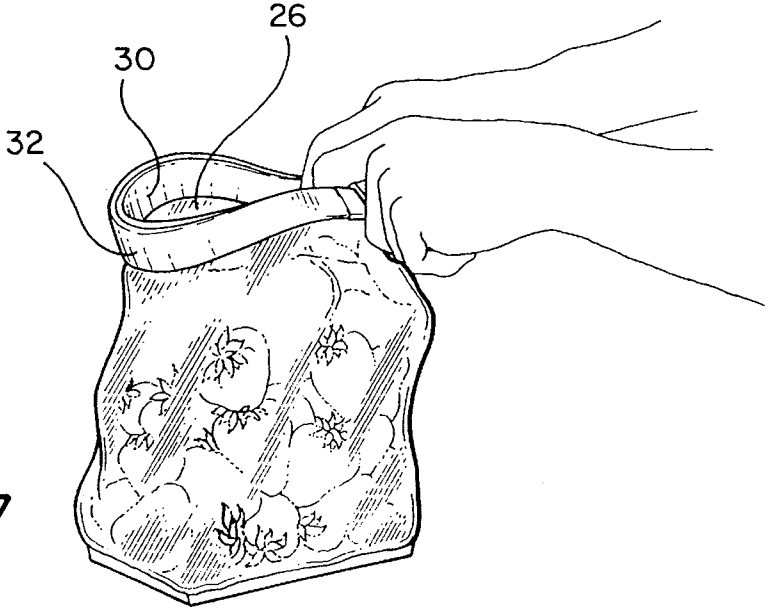
FIG. 10

FLEXIBLE CONTAINER

FIELD OF THE INVENTION

This invention relates to flexible containers, particularly flexible re-usable containers for food.

BACKGROUND OF THE INVENTION

Plastic bags are commonly used for storing food in refrigerators. The plastic bags are popular because they alleviate the problem of air drying out the food, take up less space than rigid containers, and can be manipulated to fit into unusually shaped spaces. However, such plastic bags are not usually re-usable, are flimsy, have no incorporated closure, are floppy when holding for filling or emptying, and cannot be made to stand up by themselves for filling.

SUMMARY OF THE PRESENT INVENTION

The present invention is concerned with providing a container which can replace the plastic bag for food storage by being re-usable and more stable to handle, fill and empty.

In general, the present invention provides a container comprising a flexible cylinder, cube, ball, or other shape, with a stiffened area around an opening and a stiffened area around an attached pivotal closure portion.

There is preferably a foot or other stiffened area either at the directly opposite end from the opening, or anywhere else on the container, that permits the container to have a sturdier footing on a surface and/or provide a gripping area.

According to a particular aspect of the present invention there is provided a flexible container comprising a pliable body of flexible material, the body having an opening with a tongue extending from a side of the opening, the tongue forming a continuation of the body and being pivotal relative to the body to close and open the opening. A stiffened portion is disposed around a peripheral portion of the opening opposite the opening side, another stiffened portion being disposed around a periphery of the tongue. These stiffened portions have ends thereof respectively hingedly connected together at opposite ends of the opening side, the tongue stiffened portion moving inside the opening stiffened portion when the tongue is pivoted to close the opening. The pliable body is collapsible to a collapsed disposition for storage when empty, and is variably adaptable in size between the collapsed disposition and an expanded maximum size disposition depending upon the volume of contents to be stored in the container.

The body may have a base portion spaced from the opening, the base portion being defined by a stiffened section of the body and the container being stably standable on the base portion. The base portion stiffened section may comprise a stiffening strip-like element extending around a closed contour.

According to another aspect of the present invention, there is provided a container comprising a readily deformable body of flexible material, the body having an open top and a closed bottom, a flap extending from a side of the open top and a thickened stiffening flange extending around the remainder of the open top, and another thickened stiffening flange extending around the flap. Two hinges hingedly connect ends of the open top flange respectively to ends of the flap flange enabling the flap to pivot relative to the body to open and close the open top. The flap flange moves inside the open top flange when the flap closes the open top to more effectively seal the open top, and the closed bottom includes a thickened stiffening portion defining a base upon which the container stably stands.

The open top flange and the flap flange may have mating surfaces which are shaped to releasably latch with each other when the flap closes the open top.

According to yet another aspect of the present invention, there is provided a container comprising a deformable body of flexible material, the body having an opening for inserting and removing contents to be placed in the container, and a closure for the opening comprising a flap of flexible material connected to the body along a hinge line having opposite ends. A flap stiffening element extends continuously around a periphery of the flap and has ends adjacent the opposite ends of the hinge line, and an opening stiffening element is connected to the body and extends partially around the opening, the opening stiffening element having two ends adjacent the opposite ends of the hinge line. The closure is pivotal about the hinge line relative to the body between a closed position, in which the flap stiffening element is disposed inside and conforms to the opening stiffening element and the closure closes the opening, and an open position pivoted away from the opening, the stiffening elements being pivotal relative to each other like a pair of jaws. The body has a stiffened base portion at a location spaced from the opening and forming a base upon which the container stands. The container is readily deformable between a collapsed state, in which the flap and opening stiffening elements lie over and close to the stiffened base portion with the deformable body crunched up and sandwiched therebetween, and an expanded state in which the flap and opening stiffening elements are spaced from the stiffened base portion with the body stretched out therebetween.

Preferably the flap, the stiffening elements, and the stiffened base portion are all integral with the body. The stiffening elements may be metal, or other material, strips incorporated inside the rim of the opening and/or inside the rim of the flap. The stiffened base portion may comprise such strips incorporated in the bottom or wall of the body of the container.

Other objects, features and advantages of the present invention will become more fully apparent from the following detailed description of the preferred embodiment, the appended claims and the accompanying drawings.

BRIEF DESCRIPTION OF THE DRAWINGS

In the accompanying drawings, in which in different Figures like reference characters indicate like parts:

FIG. 1 is a front perspective view of a flexible, re-usable container according to the present invention;

FIG. 2 is a side perspective view of the container of FIG. 1;

FIG. 3 is a top view of the container of FIG. 1;

FIG. 4 is a bottom view of the container of FIG. 1;

Figure 7A:
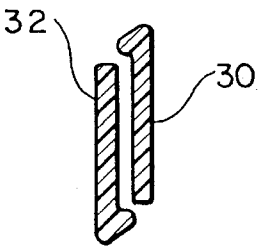
Figure 7B:
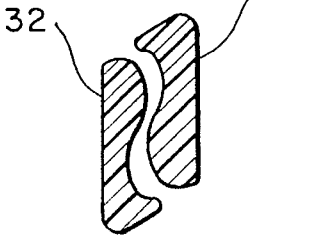
Figure 6:
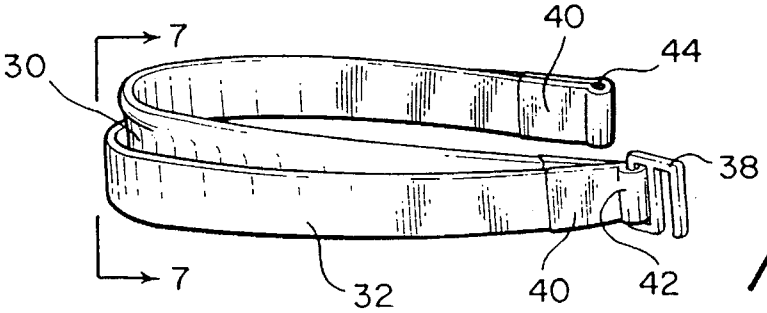
Figure 12:
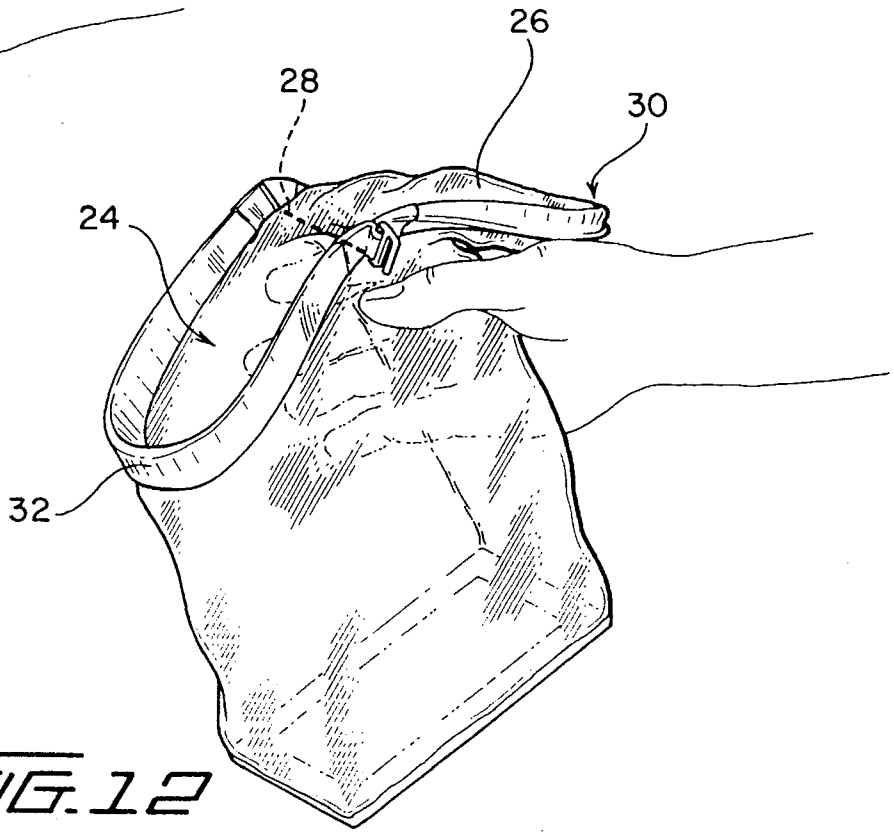
Figure 11:
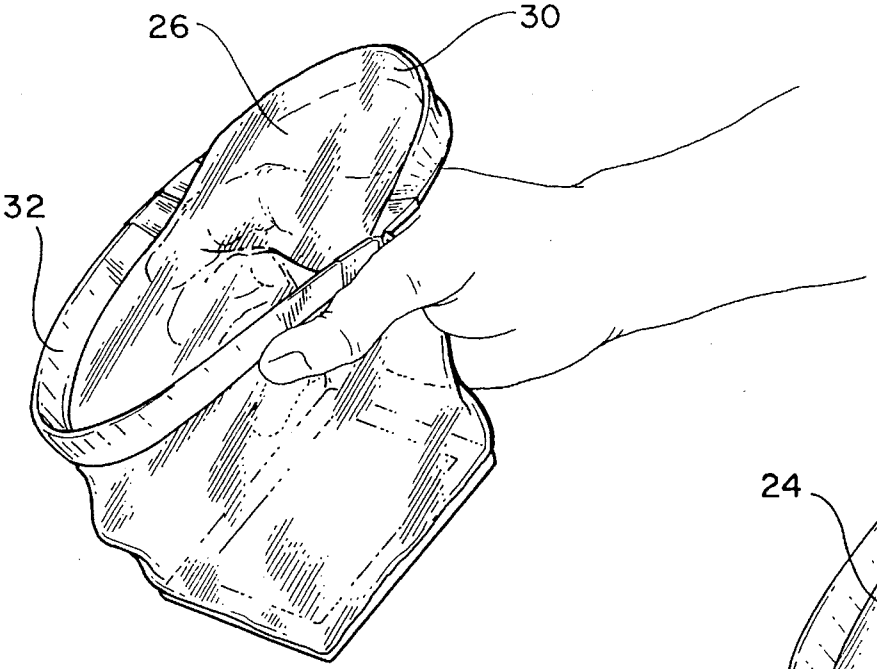
Figure 15:
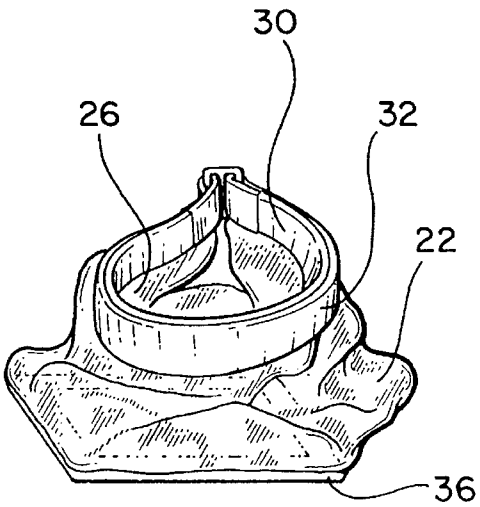
Figure 14:
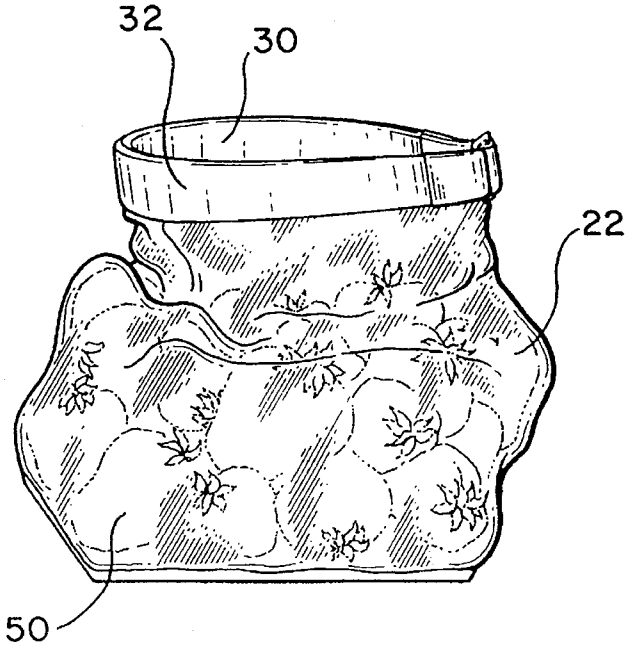
Figure 13:
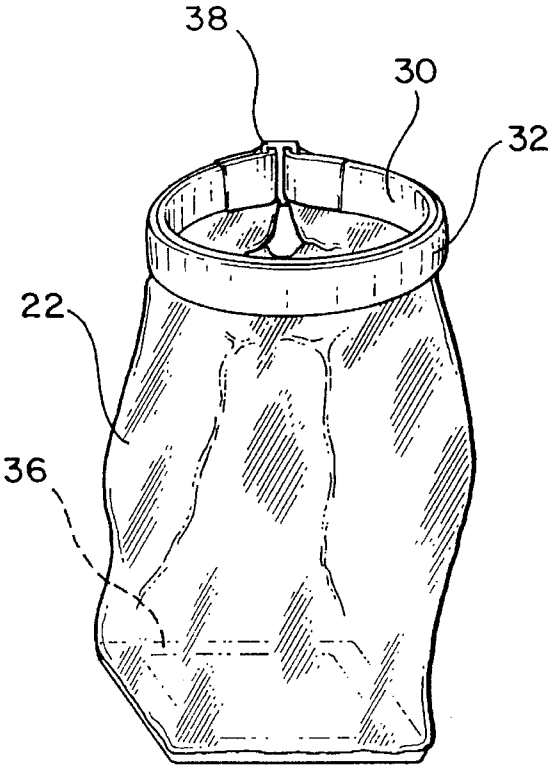
Figure 16:
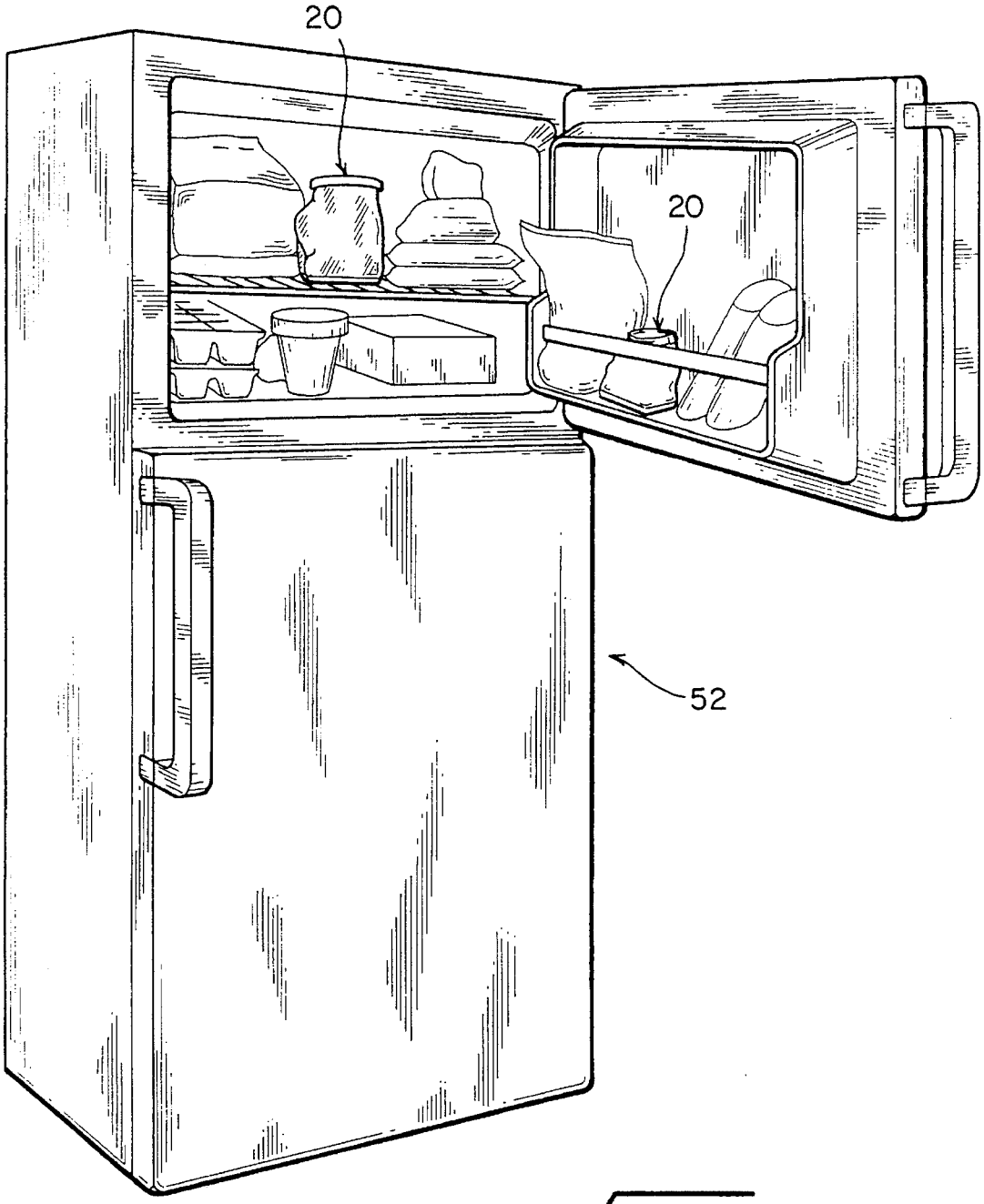
Figure 17:
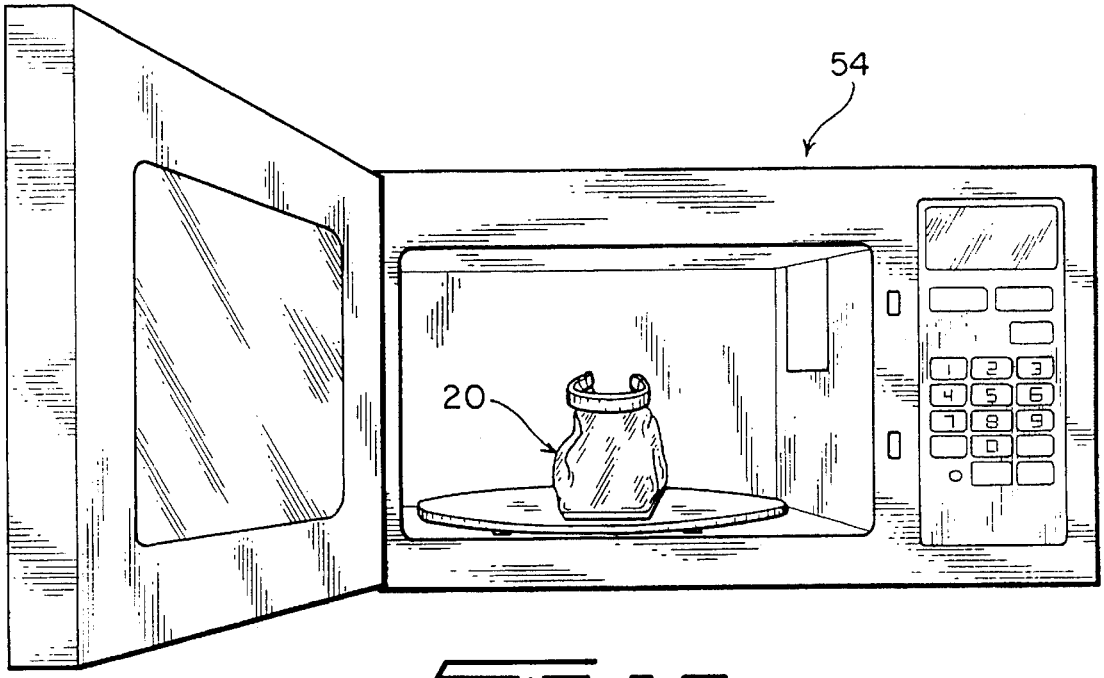
Figure 19:
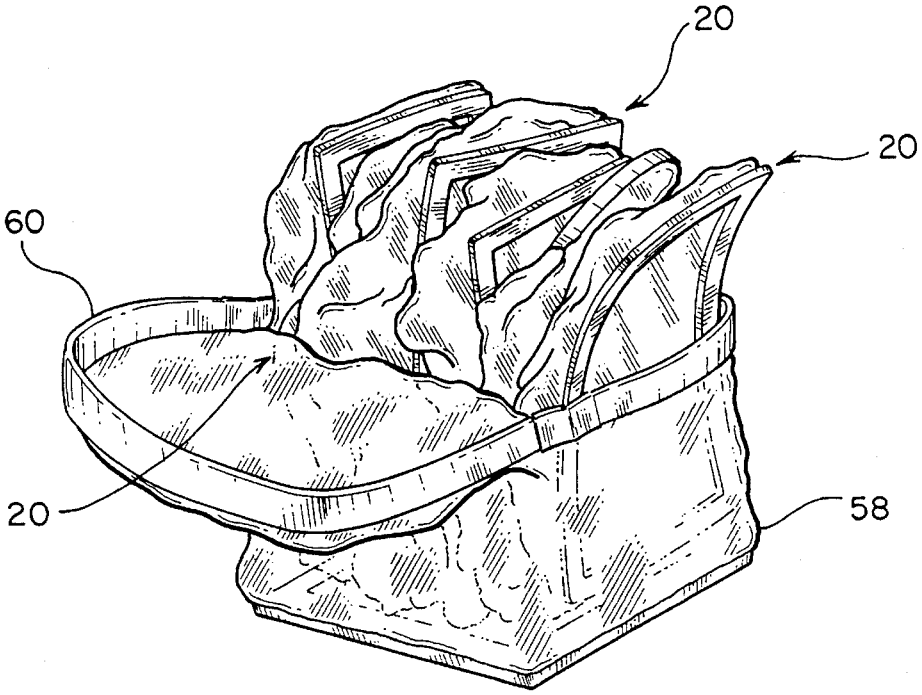
Figure 18:
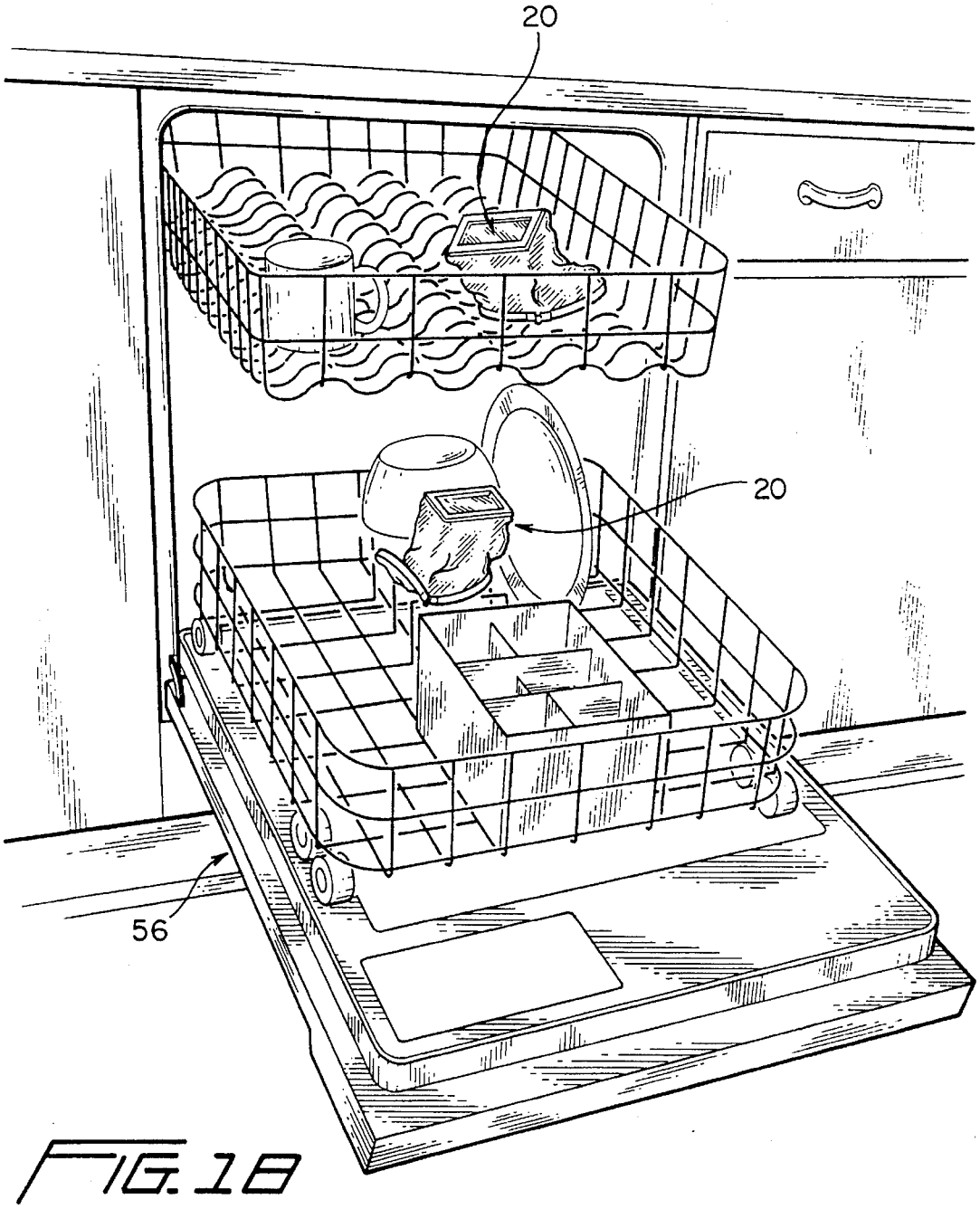

FIG. *5a* is a diagrammatic side perspective view of hinged jaws of the container opened but before the jaw on the right is twisted for closure;

FIG. *5b* is a similar view to FIG. *5a* but with the intermediate portion of the jaw on the right now twisted through 180 degrees, and with an arrow showing the direction of closure of the right jaw to the left jaw;

FIG. 6 is a diagrammatic side perspective view of the jaws of FIG. *5b* in a substantially closed position;

FIGS. 7*a* and 7*b* are schematic sections on the line 7—7 of FIG. 6 illustrating two modifications of the jaws according to the invention;

FIG. 8 is a perspective view of the container of FIG. 1 in a fully open position and being filled by hand with fruit;

FIG. 9 is a view similar to FIG. 8 and showing the closure being pivoted to close the partially filled container;

FIG. 10 shows the container of FIG. 9 now fully closed;

FIG. 11 is a perspective view illustrating handling to pour out the contents of the container of FIG. 1;

FIG. 12 is a perspective view illustrating handling to lift the container of FIG. 1 when fully open;

FIGS. 13, 14 and 15 illustrate the container of FIG. 1 when fully extended, partially filled and crunched, and fully crunched, respectively;

FIGS. 16, 17 and 18 illustrate containers of FIG. 1 being employed in a refrigerator freezer, a microwave oven, and a dishwashing machine, respectively; and FIG. 19 illustrates a stack of the containers of FIG. 1 being stored in a fully crunched condition in a handled carrier.

DETAILED DESCRIPTION OF THE PREFERRED EMBODIMENTS

The preferred embodiment of the container of the present invention is illustrated in FIGS. 1 to 6 and 8 to 15 with two modifications of a detail being illustrated in FIGS. 7*a* and 7*b*. Functions that the container can undergo or perform and manners of using this container are illustrated in FIGS. 16 to 19.

As shown in FIGS. 1 to 4, the container 20 has a transparent deformable and pliable body 22 of medium thickness sheet-like plastic material which is flexible and can withstand the freezing temperatures of a freezer, the cooking temperatures of a microwave oven, and the hot detergent water of a dishwasher. Ethylene vinyl acetate may be employed, but preferably polypropylene is incorporated, either during extrusion of the ethylene vinyl acetate or during molding of the container. Preferably, 10% to 20% by volume of polypropylene is added to the ethylene vinyl acetate. The incorporation of the polypropylene is intended to improve the material for withstanding refrigerator, freezer, microwave and dishwasher temperatures and conditions.

Figure 5A:
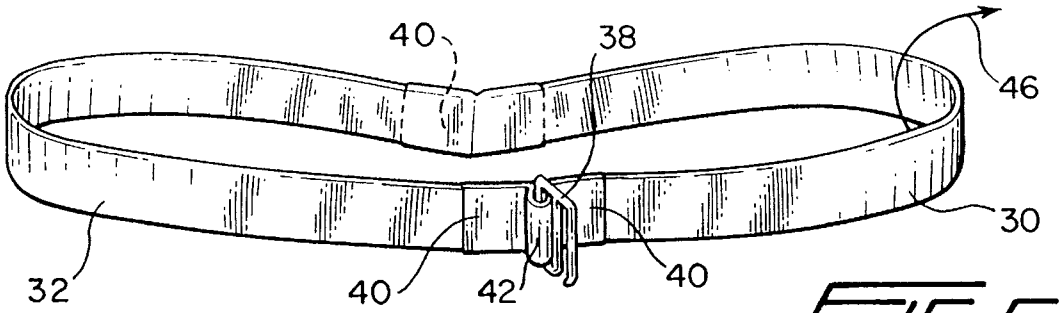
Figure 5B:
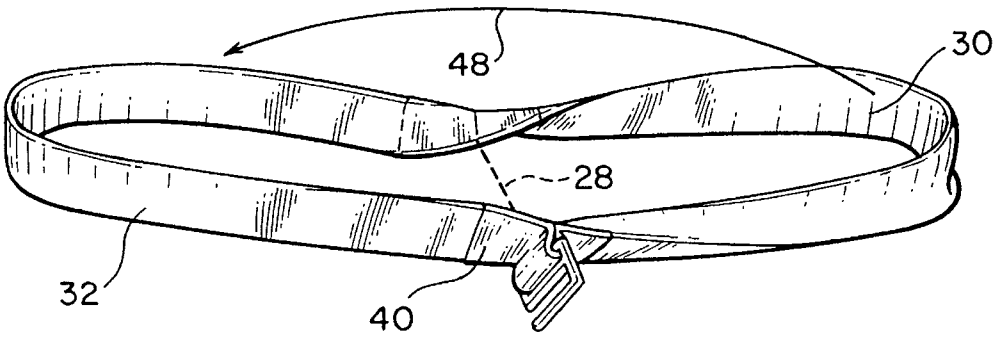

The body 22 is a sleeve-like bag with an open top defining an access opening 24 as clearly shown in FIGS. 8, 9 and 12. A flap or tongue 26 (see also FIGS. 8 to 12) extends from the body 22 at one side of the opening 24, the flap 26 connecting with the body 22 at the rear of the container 20 along a theoretical hinge line 28 as schematically illustrated in FIGS. 5*b* and 12.

A stiffening element 30 extends around the periphery of the flap 26, the ends of the stiffening element 30 terminating adjacent the ends of the theoretical hinge line 28. Another stiffening element 32 extends partially around the periphery of the opening, starting at one end of the hinge line 28 and finishing at the other end of the hinge line 28 as can be seen in FIGS. 5*b* and 12. Both stiffening elements 30, 32 are strip-like and bent into a general U-shaped configuration as clearly shown in FIG. 11. The stiffening elements can be strips of the same material as the body 22 but about three millimeters in thickness and about one centimeter in depth, the thickness of the flexible material of the body being substantially less than one millimeter. These strips can be connected to the body and flap material, respectively, with any suitable adhesive, or by heat sealing, or by any other suitable manner of attachment. The strips are attached to the outside surface of the body 22 and the outside surface (as viewed in FIGS. 5*a* and 8) of the flap 26. Similarly, the flap could be attached to the body 22. Preferably, however, the flap is formed integrally with the body, the stiffening element 30 is formed integrally with the flap 26, and the stiffening element 32 is formed integrally with the body 22; the stiffening elements 30, 32 are then formed as stiffened portions disposed around the periphery of the flap and around the periphery of the opening 24 opposite the hinge line 28. In either case, the stiffening elements 30, 32 can be viewed as thickened stiffening flanges.

The closed end of the body 22 forms a base 34 and includes a stiffened base portion to facilitate the container standing stably on the base. This stiffened base portion or section can be in the form of a closed contour frame, e.g. a circle, polygon or other footprint. The footprint could be plate-like instead of a frame. As shown in FIG. 4, the stiffened section 36 may conveniently be in the form of a rectangular or square frame, being made up of four consecutive strips of flexible material each at right angles to the next and several times thicker than the thickness of the material of the body 22. These four strips are similar to the strips described above for making up the stiffening elements 30, 32, and are glued with vinyl glue to the base 34. Preferably, however, the stiffened base portion 36 is formed integrally with the body 22.

After the flap 26 and stiffening element 30 are moved, as in FIG. 9, to close the container opening 24 with the stiffening element 30 nesting inside the opening stiffening element 32, the ends of these elements 30, 32 are brought together as in FIG. 10. A hook 38, or other clip, is deployed to connect the ends of the stiffening elements 30, 32 together as can be seen in FIGS. 1 to 3. This deforms the stiffening elements 30, 32 from their normal somewhat U-shape, as seen in FIGS. 5*a*, 9 and 11, to a somewhat tear drop shape, as seen in FIGS. 2 and 3. This more constricted tear drop shape causes the outer stiffening element 32 to more tightly engage against and conform to the inner stiffening element 30 to effect a better air-tight seal. In this way, the container can be hermetically sealed, and this is of particular advantage when storing foodstuff in the container. It should be noted that the stiffening elements may directly engage or engage with one or two peripheral wall portions of the body 22 and flap 26 sandwiched between them.

The ends of the flap stiffening element or flange 30 are hingedly connected to the respective ends of the opening stiffening element or flange 32. Various hinges can be employed to accomplish this, but preferably the hinges 40 are formed by strips of flexible material similar in thickness to the flexible material of the body 22. In the orientation of the U-shaped elements 30, 32 in FIG. 5*a* (as also in FIG. 8), the hinge strips 40 are glued to the outside surfaces of the ends of the elements 30, 32 with the respective pairs of ends abutting or spaced slightly from each other. As can be seen partly in FIG. 5*a* and partly in FIG. 6, the hinge strips form an outwardly directed loop 42, 44 at the junction of respective pairs of abutting ends of the stiffening elements 30, 32. The hook 38 has an attachment ring which passes through, and is so anchored in, the loop 42; this can best be seen in FIGS. 5*a* and 6. The hook 38 is inserted, by hand, removably in the loop 44 to hold the stiffening elements 30, 32 in the pear drop shaped configuration seen in FIGS. 2 and 3.

Instead of applying separate strips 40 to the elements 30, 32, these hinges 40 may be integrally formed with the elements 30, 32, particularly when the elements 30, 32 are integrally formed with the body 22.

With the stiffening elements 30, 32 opened at 180 degrees to each other as in FIG. 5*a*, in which the body 22 has been omitted for simplicity, the central portion of the flap stiffening element 30 is twisted in the direction of the arrow 46 through 180 degrees before attempting to close the container. The orientation of the element 30 is then as shown in FIG. 5*b*, with the orientation of the opening stiffening element 32 remaining the same as previously shown in FIG. 5*a*. The hinge line 28, previously referred to, extends between the middles of the hinges 40. To close the container, the flap element 30 is pivoted about the hinge line 28 in the direction of the arrow 48 through approximately 180 degrees as indicated in FIG. 5*b*.

FIG. 6 shows the substantially closed position of the elements 30, 32 after pivoting as in FIG. 5*b*. It should be noted that due to the elements pivoting about an axis 28 originally substantially at right angles to the axes of the loops 42, 44, the twist in the flap element 30 has been dissipated and the flap element now lies untwisted inside and in complete conformity with the opening element 32. Conveniently, whenever the closure 26, 30 is opened thereafter, the flap element 30 can be opened to the twisted configuration as in FIG. 5*b;* this can be seen in FIGS. 11 and 12 in which the flap 26 bulges up inside the U-shaped element 30 when the closure is fully open.

FIGS. 7*a* and 7*b* are simplified diagrammatic sections on the line 7—7 in FIG. 6.

FIG. 7*a* illustrates the cross-sectional shape of the elements 30, 32 in a first modification. As will be seen, each element 30, 32 has an enlarged edge shaped to form an abutment limiting the insertion of the flap element 30 inside the opening element 32.

FIG. 7*b* illustrates the cross-sectional shape of the elements 30, 32 in a second modification in which the confronting surfaces are shaped to mate with each other in a releasable latching manner. The curved mating profiles allow the elements 30, 32 to smoothly ride over each other while producing an effective latching action. This latching action is intensified when the hinges 40 are brought into abutting relationship as in FIGS. 1, 2 and 3.

FIG. 8 shows the container 20 opened as in FIG. 5*a* and being filled with fruit 50 by hand.

FIG. 9 shows the partially filled container 22 being closed by hand in the direction of the arrow 48, but after the flap stiffening element 30 has been twisted as in FIG. 5*b*. It should be noted how the hand simply presses with the fingers against the now inwardly deformed flap 26 to effect closure.

FIG. 10 illustrates the hinges being drawn together by hand for the hook 38 (see FIG. 6) of one hinge 40 to be inserted in the loop 44 of the other hinge to effect the sealed pear drop shape configuration of the stiffening elements as shown in FIG. 2.

It will be apparent from FIGS. 5*a*, 5*b*, 6, 8, and 9 that the stiffening elements 30, 32 are pivotal relative to each other like a pair of jaws, this being most readily noticeable in FIG. 9. However, when the jaws are fully closed, the "upper" jaw passes inside the "lower" jaw to form a more effective seal.

FIG. 11 shows how the opened container can be held in one hand when pouring out the contents from the container. In this pouring action, the U-shaped stiffening element forms a wide, gently curved pouring lip.

FIG. 12 illustrates how the fully opened container can be grasped in one hand below and behind the theoretical hinge line 28 when lifting the container, when full or empty.

FIGS. 13 to 15 illustrate how the container is readily and easily adaptable in size. FIG. 13 shows the full size of the closed container with the engaged stiffening elements 30, 32 pulled fully upwards away from the base stiffening section 36 to fully extend the length (i.e. height) of the body 22. FIG. 14 shows the container partially filled with food, e.g. fruit or vegetables, and the engaged stiffening elements 30, 32 pushed downwards to adjacent the contents 50. The deformable body 22 is crunched up, mainly between the elements 30, 32 and the top of the contents 50, to shorten the height of the container. This crunching up of the body 22 is effected before the container is fully closed to enable excess air to be squeezed out of the partially filled container. FIG. 15 shows an empty container in which the stiffening elements 30, 32 have been pushed down to adjacent the base stiffening section 36 with the flexible body 22 fully crunched up and sandwiched between the elements 30, 32 and the section 36. When so collapsing the container, the inside air is allowed to escape before complete closure of the container is effected. In the fully crunched container, the closure flap 26 lies next to the bottom of the body 22. This substantially reduces the overall size of the container for storage when empty.

FIG. 16 shows two closed containers 20 being used to store food in the freezer section of a refrigerator 52.

FIG. 17 shows a container 20, with its food contents, placed in a microwave oven 54 for heating the contents while in the container 20. Note that the stiffening elements have been unhooked to facilitate escape of air and vapor during heating. If desired the closure could be partially opened.

FIG. 18 shows two fully opened containers 20 placed upside down in a dishwashing machine 56 for washing.

FIG. 19 shows several opened and fully crunched containers 20 assembled as a pack in a carrier 58 having a carrying handle strap 60.

The closure, i.e. the flap 26 and surrounding stiffening element 30, is preferably very slightly larger than the portion of the opening 24 with stiffening element 32. This then necessitates pushing down the closure within the reinforced opening as a snug fit. Thereafter, by clasping the two points where the flap stiffener flange 30 and the opening stiffener flange 32 come together and connecting as in FIG. 3 with the hook 38 or other releasable fastener, compression is created within the stiffening flange of the flap and tension is created within the stiffening flange of the opening. This holds the container tightly closed.

As will be appreciated from the foregoing, the preferred embodiment of the present invention provides a transparent, flexible, re-usable container which can withstand the extremes of freezer and microwave oven temperatures, can readily be adapted in size particularly to expel excess air, can be washed in a dishwasher, can readily be handled for filling or pouring, can be virtually flattened for storage, is stable to stand up, and is not breakable. This container is particularly suited for storing food, both fresh food and left-over cooked food.

The container can be made by cutting-out, or separately forming, the various components, and then connecting the components together, e.g. by gluing or otherwise as described above. Alternatively, the container, or a substantial portion thereof, could be blow molded, or even vacuum drawn. Preferably, the container is made by a combination of injection and blow molding to form a seamless container. The injection molded part should be first formed, then the inside mold removed leaving the injection molded part still set in the walls, then the blow molded section is formed. The container could also be made by a two stage molding process with the jaws and base support being injection molded by one machine, and then these molded parts being inserted in a second machine for blow molding onto or into.

In place of the hook 38, other arrangements may be employed for securing the stiffening elements together in a deformed configuration to intensify engagement between the stiffening elements when the container is closed. For example, the pivoted ends of the stiffening elements can be arranged to telescope one inside the other so deforming the stiffening elements into a closed loop, for example a circle, to draw the outer opening flange element more tightly around the inner flap flange element. Alternatively, one of the hinged pair of ends of the stiffening flanges can be releasably snap fastened to the inside or the outside of the other of the hinged pair of flange ends. Another means for releasably retaining the stiffening flanges deformed in intensified engagement involves incorporating a C-shaped piece of plastic or metal inside the stiffening flange of the flap. The stiffening flanges can then be deformed into a C-shape for obtaining the intensified engagement, the inner flap flange having a slightly larger C-shaped outer circumference than the inner circumference of the surrounding opening flange. To release the intensified engagement for opening the flap, the C-shape is opened up to a somewhat U-shape.

The above described embodiments, of course, are not to be construed as limiting the breadth of the present invention. Modifications, and other alternative constructions, will be apparent which are within the spirit and scope of the invention as defined in the appended claims.

I claim:

1. A flexible container, comprising:

a pliable body of flexible material;

the body having an opening with a tongue extending from a side of the opening, the tongue forming a continuation of the body and being pivotal relative to the body to close and open the opening;

a stiffened portion disposed around a peripheral portion of the opening opposite said side;

another stiffened portion disposed around a periphery of said tongue;

said stiffened portions having ends thereof respectively hingedly connected together at opposite ends of said side;

said tongue stiffened portion moving inside said opening stiffened portion when said tongue is pivoted to close said opening; and said pliable body being collapsible to a collapsed disposition for storage when empty, and being variably adaptable in size between said collapsed disposition and an expanded maximum size disposition depending upon the volume of contents to be stored in the container.

2. The container of claim 1, wherein said body has a base portion spaced from said opening, said base portion being defined by a stiffened section of said body and said container being stably standable on said base portion.

3. The container of claim 2, wherein said base portion is located opposite said opening, the base portion forming a bottom of the container and the opening defining a top of the container.

4. The container of claim 2, wherein said base portion stiffened section comprises a stiffening strip-like element extending around a closed contour.

5. The container of claim 4, wherein said base portion stiffened section is integral with said flexible material of said body.

6. The container of claim 1, wherein said stiffened portions are hingedly connected together by strips of flexible material.

7. The container of claim 1, further comprising a securing member attached to said container adjacent one end of said side and releasably engaging said container adjacent the other end of said side to releasably hold said side ends next to each other when said opening is closed by said tongue.

8. The container of claim 7, wherein the ends of said stiffened portions are hingedly connected together by two hinges, and said securing member is a clip mounted on one of said hinges and releasably engageable with the other of said hinges.

9. The container of claim 1, wherein each said stiffened portion comprises a curved strip-like element.

10. The container of claim 9, wherein the curved strip-like element around said tongue has an intermediate section which becomes twisted lengthwise through about 180 degrees with respect to the ends of this strip when said tongue is pivoted back through 180 degrees away from said opening, and the curved strip-like element around said peripheral portion of the opening does not become so twisted.

11. The container of claim 1, wherein said flexible material comprises ethylene vinyl acetate incorporating polypropylene.

12. A container, comprising:

a readily deformable body of flexible material;

said body having an open top and a closed bottom;

a flap extending from a side of the open top and a thickened stiffening flange extending around the remainder of the open top;

another thickened stiffening flange extending around said flap;

two hinges hingedly connecting ends of the open top flange respectively to ends of the flap flange enabling the flap to pivot relative to the body to open and close said open top;

said flap flange moving inside said open top flange when said flap closes said open top to more effectively seal said open top; and said closed bottom including a thickened stiffening portion defining a base upon which the container stably stands.

13. The container of claim 12, wherein each of said stiffening flanges is in the form of a curved strip-like configuration.

14. The container of claim 12, wherein said hinges comprise strips of flexible material.

15. The container of claim 13, wherein said curved strip-like configurations are U-shaped, and further comprising a coupling releasably coupling said hinges together when said open top is closed to deform each of said strip-like configurations from being U-shaped to being tear drop shaped.

16. The container of claim 12, wherein, after said open top is closed by said flap, said stiffening flanges are deformable simultaneously to tighten one of said flanges around the other to intensify engagement therebetween, and further comprising means for releasably retaining said stiffening flanges deformed in such intensified engagement.

17. The container of claim 12, wherein said open top flange and said flap flange have mating surfaces which are shaped to releasably latch with each other when said flap closes said open top.

18. The container of claim 12, wherein said flexible material can withstand freezing in a refrigerator, heating in a microwave oven, and washing in a dishwashing machine enabling said container to be re-usable repeatedly.

19. A container, comprising:

a deformable body of flexible material, the body having an opening for inserting and removing contents to be placed in the container;

a closure for said opening comprising a flap of flexible material connected to said body along a hinge line having opposite ends;

a flap stiffening element extending continuously around a periphery of said flap and having ends adjacent said opposite ends of said hinge line;

an opening stiffening element connected to said body and extending partially around said opening, said opening stiffening element having two ends adjacent said opposite ends of said hinge line;

said closure being pivotal about said hinge line relative to said body between a closed position, in which said flap stiffening element is disposed inside and conforms to said opening stiffening element and said closure closes said opening, and an open position extending away from said opening, said stiffening elements being pivotal relative to each other like a pair of jaws;

said body having a stiffened base portion at a location spaced from said opening and forming a base upon which the container stands; and said container being readily deformable between a collapsed state, in which said flap and opening stiffening elements lie over and in close proximity to said stiffened base portion with said deformable body crunched up and sandwiched therebetween, and an expanded state in which said flap and opening stiffening elements are spaced from said stiffened base portion with said body stretched out therebetween.

20. The container of claim 19, wherein said flap, said stiffening elements, and said stiffened base portion are all integral with said body.

* * * * *